US006092792A

United States Patent [19]

Camara

[11] Patent Number: 6,092,792

[45] Date of Patent: Jul. 25, 2000

[54] PORTABLE ENVIRONMENTAL BARRIER APPARATUS

[76] Inventor: Kevin Camara, 534 Edelweiss Dr., San Jose, Calif. 95136

[21] Appl. No.: 09/020,458

[22] Filed: Feb. 9, 1998

Related U.S. Application Data

[60] Provisional application No. 60/037,876, Feb. 10, 1997.

[51] Int. Cl.[7] ..... E04H 17/00

[52] U.S. Cl. ..... 256/24; 256/25; 135/87; 135/904; 160/135

[58] Field of Search ..... 256/24, 25, 26, 256/45, 12.5, 73; 135/114, 118, 900, 902, 904; 160/135; 224/153, 583, 582; 383/4

[56] References Cited

U.S. PATENT DOCUMENTS

| | | | |
|---|---|---|---|
| D. 376,636 | 12/1996 | Betz | D21/253 |
| 1,288,518 | 12/1918 | Collier | 135/114 X |
| 2,208,458 | 7/1940 | Julian et al. | 256/25 X |
| 2,771,088 | 11/1956 | Soldan | 256/12.5 X |
| 2,882,913 | 4/1959 | Beauregard | 135/87 X |
| 3,537,688 | 11/1970 | Stein | 256/24 |
| 4,154,323 | 5/1979 | Sneider | 383/4 X |
| 4,576,364 | 3/1986 | O'Fearna | 256/24 |
| 4,606,070 | 8/1986 | Schachter | 383/4 |
| 4,621,653 | 11/1986 | Aquino | 135/117 |
| 4,685,484 | 8/1987 | Moneta | 135/900 X |
| 4,778,090 | 10/1988 | Facchina | 224/153 |
| 4,860,777 | 8/1989 | Orlando | 135/902 X |
| 4,969,500 | 11/1990 | Makosa | 160/135 |
| 5,029,819 | 7/1991 | Kane | 256/24 |
| 5,033,719 | 7/1991 | Cardente | 256/24 |
| 5,054,507 | 10/1991 | Sparks | 135/97 |
| 5,062,234 | 11/1991 | Green | 43/1 |
| 5,865,355 | 2/1999 | Camara | 256/25 X |

FOREIGN PATENT DOCUMENTS

| | | | |
|---|---|---|---|
| 261102 | 6/1963 | Australia | 135/904 |
| 9216708 | 10/1992 | WIPO | 135/87 |

*Primary Examiner*—Harry C. Kim

*Attorney, Agent, or Firm*—John Klos, Esq.; Larkin, Hoffman, Daly & Lindgren, Ltd.

[57] ABSTRACT

A portable barrier apparatus is disclosed in this specification defining a multi-sectioned barrier for protection against wind and sand in various outdoor environments. Additionally the barrier may assembled and used as a child or pet restraint enclosure, a privacy barrier, or a temporary personal effect storage site. The apparatus includes a connected plurality of flexible barrier panel members which may be supported in an upright manner with a plurality of pole members. The apparatus further includes a protective panel member which generally covers the barrier panel members in an undeployed configuration. The invention provides a compact transport-configured package for user carrying of the barrier.

21 Claims, 6 Drawing Sheets

PORTABLE ENVIRONMENTAL BARRIER APPARATUS

CROSS REFERENCE TO RELATED APPLICATION

This application claims the benefit of priority pursuant to 35 USC § 119 (e)(1) from the provisional patent application filed pursuant to 35 USC §111(b) as Serial No. 60/037,876 on Feb. 10, 1997.

BACKGROUND OF THE INVENTION

1. Field of the Invention

The field of the present invention relates generally to improvements in portable environmental barriers, and more particularly to a portable screen that can be folded and rolled-up into a compact configuration for storage and transport. Portable screen barriers are particularly useful in outdoor environments to provide protection from blowing dirt, sand, and other debris. When used as a wind barrier, these devices are especially useful in beach environments where wind blown sand and other debris may be a nuisance. Alternative uses for the portable environmental barrier of the present invention include a child or pet restraint enclosure, a privacy barrier, and a temporary equipment and personal effect storage site.

2. Brief Discussion of the Prior Art

The use of portable screen apparatuses in various environments is known in the prior art. In an outdoor environment, the use of wind screens is desirable to prevent wind blown dirt, sand, and other debris from contacting the user thereof or otherwise being deposited upon the user. Additionally, wind screens may desirably provide a degree of privacy to a user or group of users. Prior art wind screens may be large fixed screens typically in the form of walls or fences. While such fixed screens are effective in providing protection against the wind and blowing objects, they are of course expensive, stationary structures which are impossible to transport. As a result, for those who find themselves outdoors on windy days either move to the shelter of a fixed wind fence or else suffer the discomfort and inconvenience of wind and blowing dirt and sand.

Typical portable screens may be multiple paneled screens vertically supported by poles inserted into the sand or soil. Some portable screens may be rolled-up into a more compact, generally cylindrical package. Examples of the prior art include U.S. Pat. No. 5,033,719 to Cardente which teaches a portable screen being a length of rectangularly shaped fabric supported by poles, and which may be rolled up from one end to the other for transport. Since the overall compactness of the Cardente rolled wind screen is limited by the length of the one-piece support poles, the Cardente screen may be bulky and cumbersome to store and transport. Similarly, U.S. Pat. Nos. 3,537,688 to Stein, 4,969,500 to Makosa, and 4,576,364 to O'Fearna all disclose portable screens which can be rolled-up for storage and transport.

BRIEF SUMMARY OF THE INVENTION

The present invention specifically addresses the above mentioned deficiencies of the prior art portable screens and barriers. More particularly, and in illustrated embodiments, the present invention is a portable flexible barrier for outdoor use. The portable barrier of the present invention may be easily carried by a user when packaged in a non-functional configuration, and deployed in a functional configuration to adequately protect the user from blowing dirt, sand and debris. Additional uses for the present invention include a child or pet restraint enclosure and a privacy screen. Still another use for the present invention may be as a temporary enclosure for equipment and personal effects for members of a team participation event. A banner or other indicia may be associated with the portable barrier to identify particular teams, groups, etc. Advantageously, the portable barrier of the present invention can be quickly assembled for use in a wide variety of outdoor settings, e.g., beach, sporting events, picnic areas, camping sites, etc. The portable environmental barrier includes a plurality of rectangular barrier members, which preferably may be formed from a single sheet of light weight fabric or other flexible material. The barrier members are supported in a generally vertical plane by support members which are secured at intervals along the length of the environmental barrier. The support members may be multi-part poles which may be deployed from a collapsed storage orientation. Still another aspect of the present invention provides that the barrier members, when transported or stored, may be folded to reduce the overall dimension of the rolled-up environmental barrier for transport. An outer protective panel member is provided which covers the rolled-up barrier member and otherwise secures the plurality of support members with the rolled-up barrier member. The outer protective member may be a heavy-weight fabric member and substantially cover the rolled-up barrier member. Similar to the barrier members, the outer protective panel member may be supported in a generally vertical plane by a pair of support members. To promote overall compactness during storage and transport, the outer protective panel member may be formed with a height that approximately equals the height of an undeployed support member. Restraining devices are provided to secure the outer protective member upon the rolled-up barrier member. A handle member is secured to the outer protective member and may further facilitate user transport of the device.

DETAILED DESCRIPTION OF THE PREFERRED EMBODIMENTS

Figure 1:
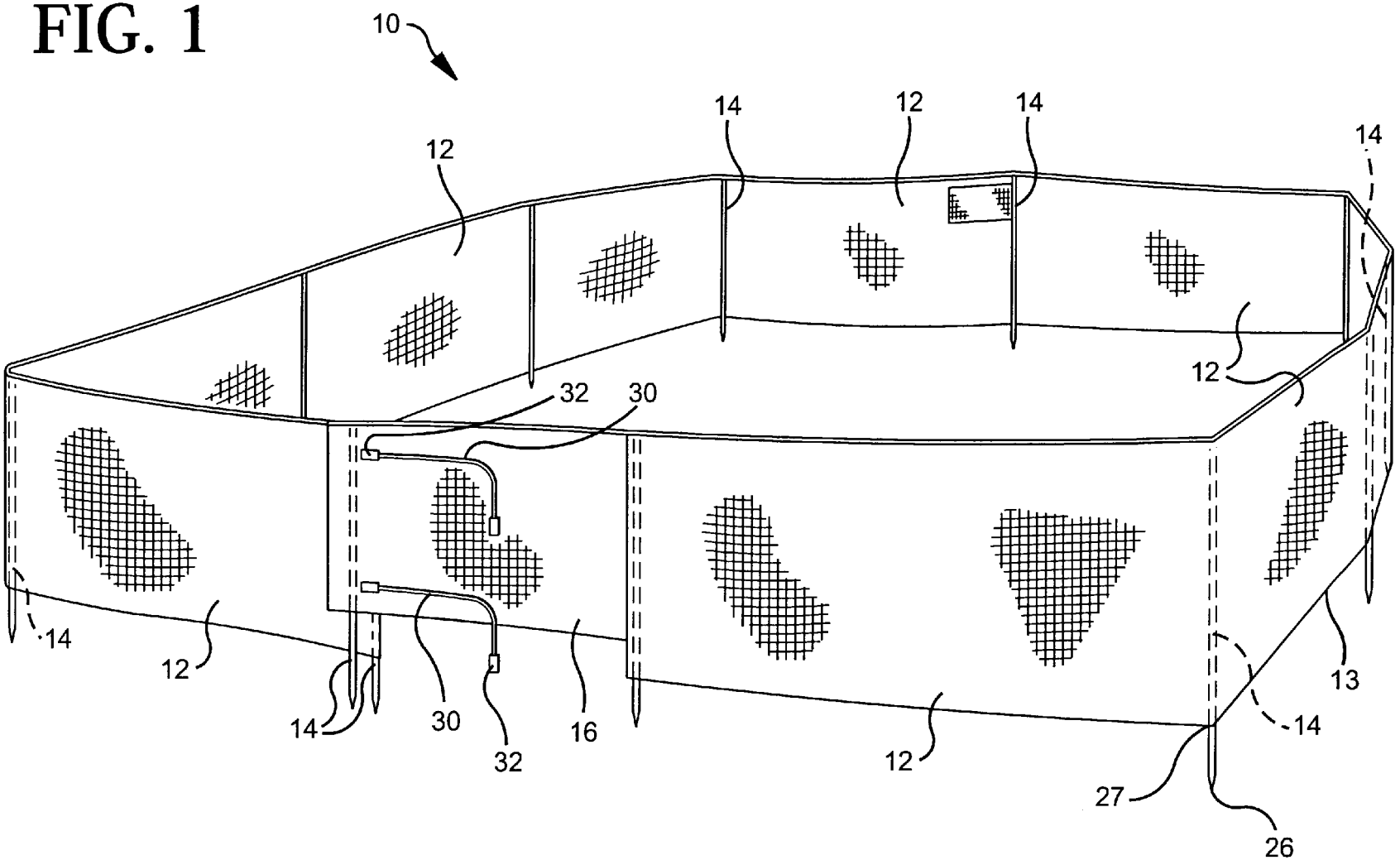
FIG. 1 is perspective view of a deployed environmental barrier according to the present inveion.

FIGS. 1–8 illustrate a first embodiment of the portable environmental barrier 10 of the present invention. The environmental barrier device 10 is illustrated in deployed orientations in FIGS. 1 and 2, and in un-deployed, non-functional storage and transport orientation in FIG. 3. As best illustrated in FIG. 1, the environmental barrier 10 includes a plurality of flexible barrier members 12 which are supported in generally vertical planes by support members 14, shown here as collapsible pole members 14. Environmental barrier 10 further includes a protective panel member 16, which similar to the barrier members 12, is a flexible member which may be supported between poles 14.

Environmental barrier 10 may be erected upon grass, sand, and other soil types in a variety of functional configurations. For instance, the environmental barrier 10 shown in FIG. 1 has been erected to enclose an area within the environmental barrier 10. Such an erected configuration may be especially desirable to provide a degree of privacy to the user or to provide an enclosed security or exercise area for children or pets. The deployed configuration of the barrier 10 of FIG. 1, may also be used as an equipment deposit site or team gathering location for team events. Alternatively with reference to FIG. 2, the environmental barrier 10 may be linearly erected, i.e. used as a wind fence structure.

Figure 2:
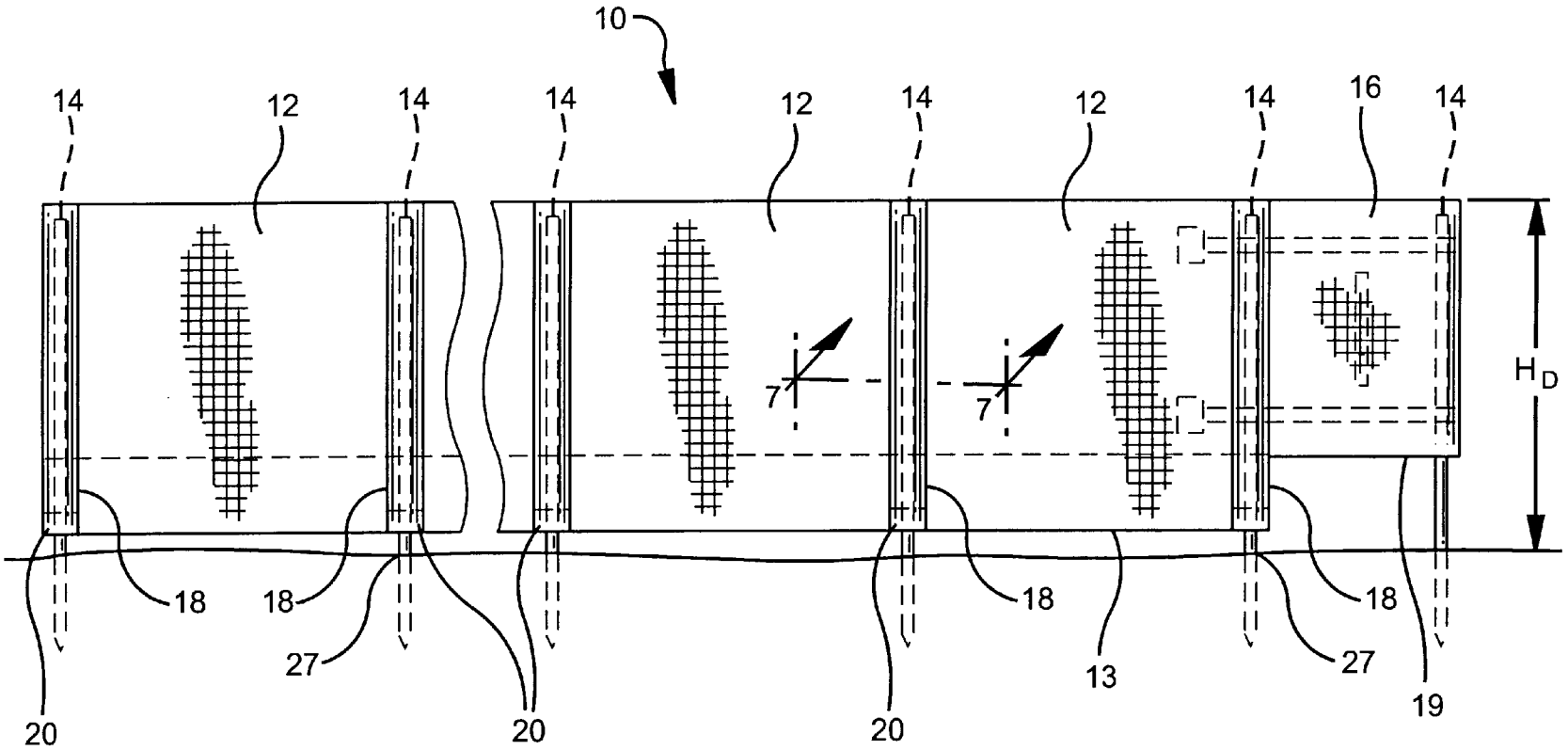
FIG. 2 is a side elevational view of a deployed environmental barrier according to the presept invention.
Figure 7:
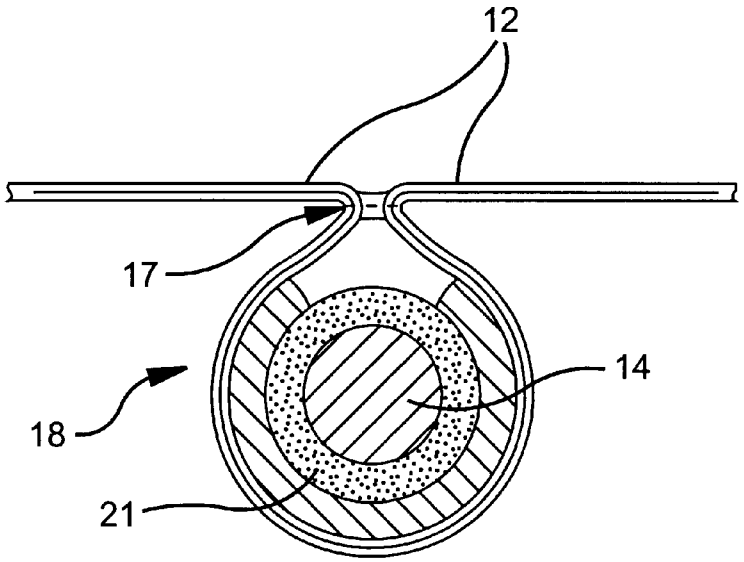
FIG. 7 is a cross-sectional view of FIG. 2, taken along lines 7—7.

Referring to FIGS. 1 and 2, environmental barrier 10 is illustrated in deployed functional orientations. Individual barrier members 12 may be manufactured from flexible material or fabric alternatives. In one embodiment, a single length of rip-stop nylon may be used as the barrier members 12. Barrier members 12 are supported at either end by poles 14 which interact with support structures 18. In the illustrated embodiments, support structures 18 are orthogonally aligned relative to the longitudinal extent of each barrier member 12. Referring to FIG. 7, individual support structures 18 may be formed by a pinch and sew procedure 17 to form a light fitting sleeve 18 for the poles 14 to slide through supporting the barrier members 12. Support structures 18 are illustrated as being formed along the entire height of the barrier members 12. Alternatively, it is appreciated that support structures 18 may be formed in a variety of manners so that the barrier members 12 can be supported by poles 14. For instance, the poles 14 may be received through a partial lower sleeve and an upper pocket member (not shown) or the poles 14 may be received through a plurality of spaced openings in the barrier members 12 (not shown). As still further examples, support structure 18 may include loops through which poles 14 may be threaded, hook and loop fastener loops or tabs, and other securing structure for temporarily maintaining contact between a pole 14 and a barrier panel member 12. As a result, a variety of pole 14/barrier member 12 interface techniques are appreciated by those skilled in the art.

Figure 4:
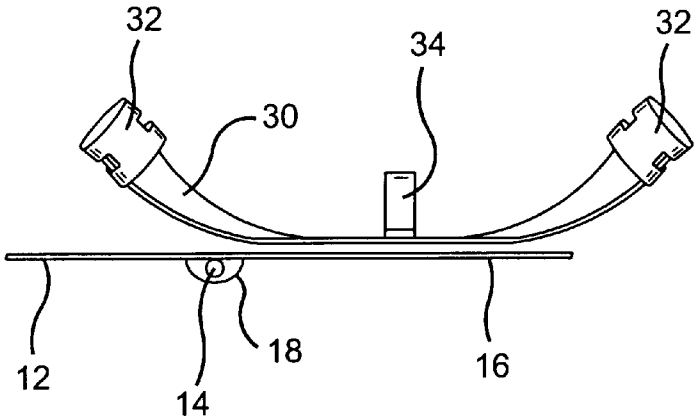
FIG. 4 is partial top plan view of the environmental barrier of FIG. 1.

Still referring to FIGS. 1 and 2, the device 10 includes a plurality of flexible barrier members 12 having a deployed height, '$H_D$' of approximately 24 inches. The deployed height of protective panel member 16 is also approximately 24 inches, though protective panel member's 16 lower edge 19 is not collinear with the barrier member's 12 lower edge 13. Referring now to FIGS. 2 and 4 the device 10 further includes a plurality of securement structure 20 for temporarily securing the poles 14 to the barrier members 12. The plurality of securement structure 20, each of which facilitate maintaining the barrier member 12 upon the pole 14 during use by preventing the barrier members 12 from sliding up the poles 14 away from the ground, may be a hook and loop fastener 21 affixed to the pole 14 and an inner surface of the support structure 18. Alternatively, the securement structure 20 may include a small hook fastened to the pole 14 and engaging the barrier member 12 near its lower edge (not shown). Other types of securement structure 20 may be readily appreciated by those skilled in the art.

Figure 5:
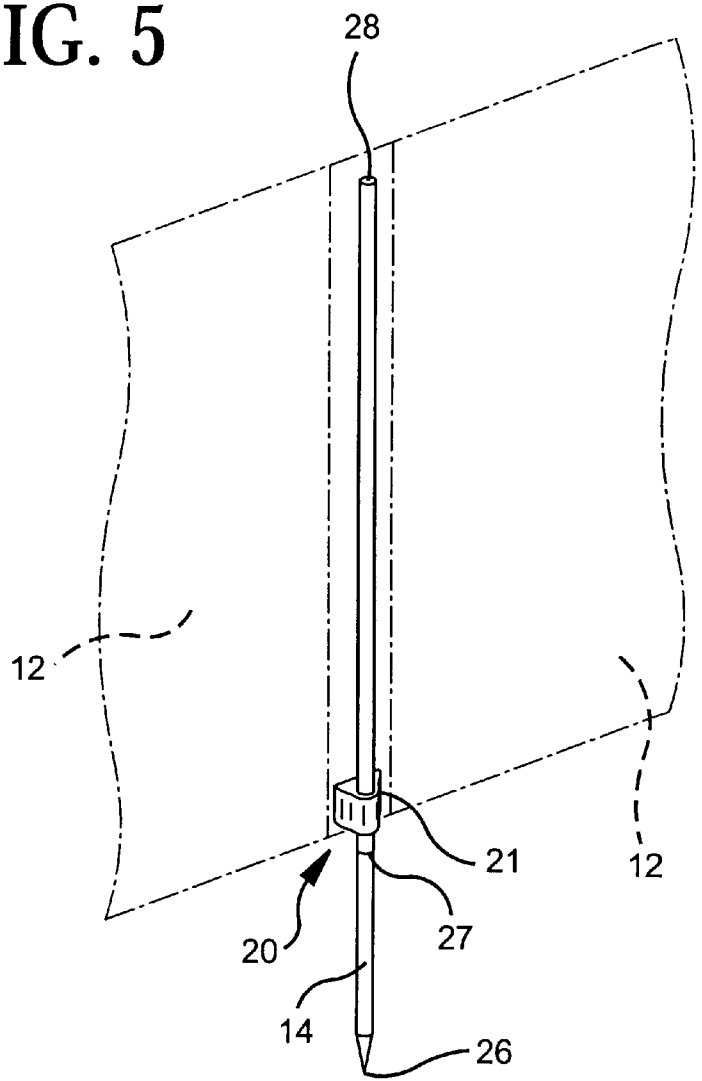
FIG. 5 is a partial perspective view of the environmental barrier of FIG. 2, taken along lines 4—4.
Figure 6:
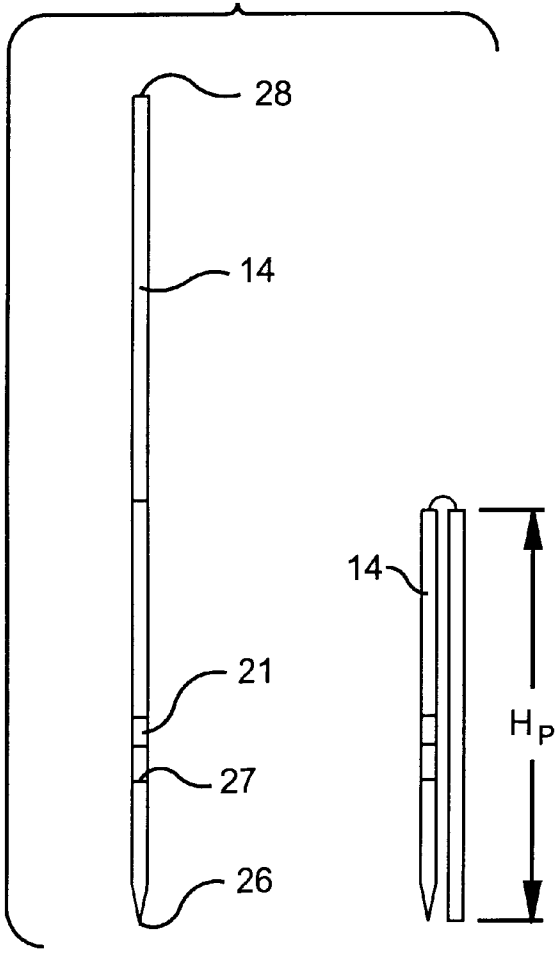
FIG. 6 is a side elevational view of deployed and collapsed pole members of the present invention.

Referring now to FIG. 6, a pair of pole members 14 are shown, illustrating the functional and non-functional configurations for the pole members 14. Poles 14 are collapsible two-part poles 14 as well known in the art. Each pole member 14 has a sharpened end 26 for soil penetration and a blunt end 28 for applying a downward insertion force. As shown in FIGS. 1, 5, and 6, each pole member 14 may include a depth indicia 27 for indicating to the assembler the desired depth to which the pole 14 is inserted in the soil. Depth indicia 27 may be a line marking on the pole 14, an O-ring secured to the pole, or any other visible marking(s). In an illustrated embodiment, depth indicia 27 is spaced approximately 8 inches away from the sharpened end 26 of the pole 14. Other multiple-part poles 14 may be practicable. Furthermore, a variety of pole configurations and materials of construction may be selected.

Figure 3:
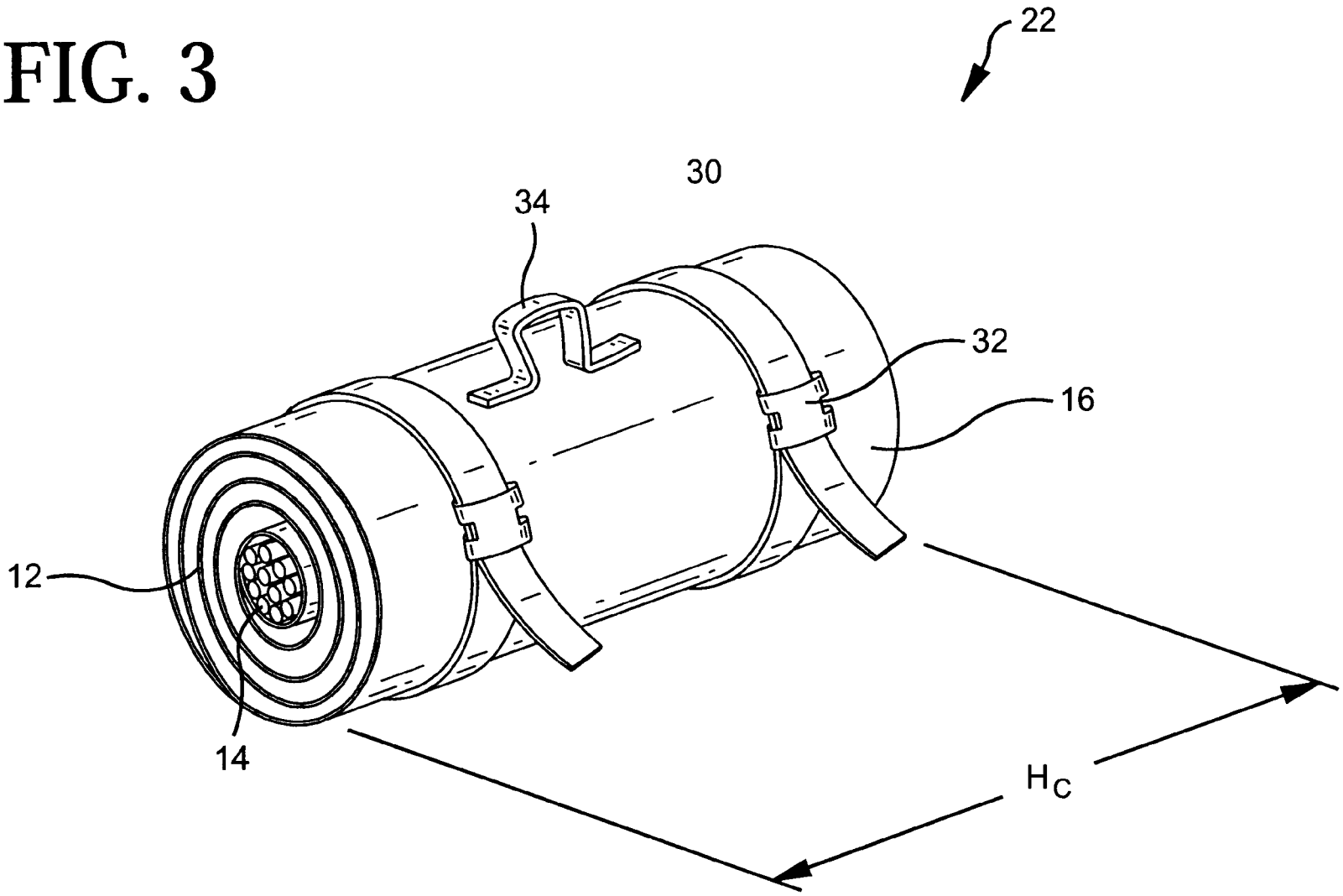
FIG. 3 a perspective view of the environmental barrier of FIGS. 1 and 2, shown in rolled transport and storage orientation.

Referring to FIG. 3, the barrier device 10 is illustrated in its non-functional storage and transport configuration as a generally cylindrical roll 22. Poles 14 may be retained near the center within the inter-rolled plurality of barrier members 22. Protective panel member 16 is sized to cover the barrier members 12 in the storage and transport configuration 22. The barrier device 10 in the non-functional storage and transport configuration 22 has an overall height dimension '$H_c$' of approximately 17–18 inches. Straps 30 are provided to secure together the protective panel member 16, plurality of barrier members 12, and poles 14. Straps 30 may be attached to the protective panel member 16 with well known techniques and may include attachment devices 32 to secure the straps 30. A handle member 34 may be provided to assist the user in transporting the device 10.

Figure 8:
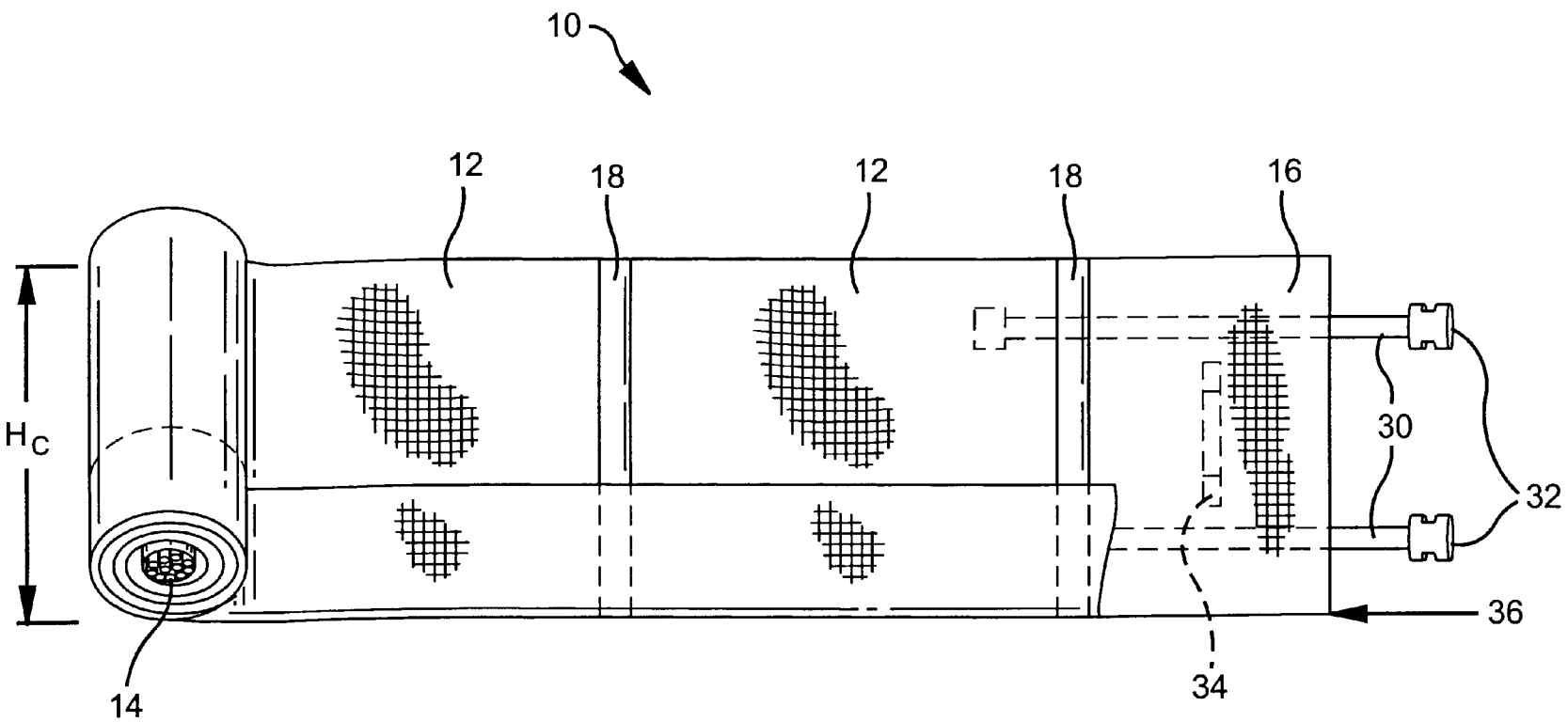
FIG. 8 is a perspective view of the environmental barriers of FIGS. 1 and 2, illustrating the folding and rolling operation of the present invention.

In operation, the user may transport the barrier device 10 in the non-functional roll orientation 22, as illustrated in FIG. 3, to a selected assembly location. When desired the user releases the securing straps 30, and un-rolls the device 10. The poles 14 are then assembled or otherwise manipulated to length and individually inserted into the support structures 18 of the barrier members 12. The securement devices 20 may then be manipulated to maintain the barrier members 12 upon the poles 14. The device 10 may next be erected in a variety of configurations, i.e., as an enclosure, fence, etc., by inserting the sharpened portion 26 of the poles 14 into the soil at desired locations to a desired depth indicated by the pole depth indicia 27. As illustrated in FIG. 8, upon departure from the location the user may collapse the device 10, remove the poles 14 from the support structures 18, fold the plurality of barrier members 12 along line 36 to reduce its overall height, place the collapsed poles 14 upon the folded plurality of barrier members 12, and roll the device 10 along its length beginning at the edge remote from the protective panel 16. Protective panel member 16 substantially covers the rolled barrier members 12 and is secured with straps 30 for transport and storage.

It is understood that the exemplary portable environmental barrier 10 described herein and shown in the drawings represents only a presently preferred embodiment of the invention. Indeed, various modifications and additions may be made to such embodiment without departing from the spirit and scope of the invention. Thus, these and other modifications and additions may be obvious to those skilled in the art and may be implemented to adapt the present invention for use in a variety of different applications.

What is claimed is:

1. A portable environmental barrier apparatus, said apparatus comprising:

a plurality of flexible barrier panel members, each of said barrier panel members being attached to at least one other of said barrier panel members, each of said plurality of flexible barrier panel members further having a pair of associated support structures, at least one of said plurality of flexible barrier panel members being composed of a first material;

a flexible protective panel member being attached to said plurality of flexible barrier panel members, said flexible protective panel member having at least one support structure, said flexible protective panel member being composed of a second material which is different than the first material;

a plurality of ground penetrable pole members for engaging the support structures and supporting said plurality of flexible barrier members and said protective panel member in an upright deployed configuration, said apparatus having a deployed height dimension when erected in said deployed configuration; and said plurality of flexible barrier panel members capable of being folded and rolled-up into a generally cylindrical transport configuration, wherein said protective panel member covers the inter-rolled plurality of barrier panel members when in said transport configuration, said transport configured roll of flexible barrier members having a transport height dimension which is substantially shorter than the overall deployed height of said apparatus.

2. Te apparatus of claim 1, wherein one or more of the plurality of pole members is individually collapsible to a reduced height, and said reduced height is approximately equal to the transport height dimension of the apparatus.

3. The apparatus according to claim 1, further comprising:

a handle secured to the flexible protective panel member.

4. The apparatus according to claim 1, further comprising:

securement structure disposed near a lower edge of the plurality of flexible barrier panel members for temporarily securing the barrier panel members to the pole members.

5. The apparatus according to claim 4, wherein the securement structure is a hook and loop fastener assembly positioned between the pole member and an interior surface of the support structure.

6. The apparatus according to claim 1, wherein the support structures are cylindrical in form and sized to receive the pole members.

7. The apparatus according to claim 1, wherein the plurality of flexible barrier panel members are formed from a single sheet of fabric.

8. The apparatus according to claim 1, wherein the first and second materials have substantially different thickness.

9. The apparatus according to claim 1, wherein the first and second materials have substantially different durability.

10. A portable environmental barrier apparatus, said apparatus comprising:

a connected plurality of flexible barrier panel members, each of said plurality having at least one support structure at least one of said plurality of flexible barrier panel members being composed of a first material;

a protective panel member secured to the connected plurality of flexible barrier panel member, said protective panel member being composed of a second material which is different than the first material; and a plurality of ground penetrable pole members for engaging the support structures and supporting the barrier panel members in an upright orientation, said apparatus having a deployed height when in said upright orientation;

said plurality of flexible barrier panel members being capable of being accumulated into a generally cylindrical transport configuration, said transport configuration having a transport height dimension which is substantially shorter than the deployed height of the apparatus.

11. The apparatus of claim 10, wherein one or more of the plurality of pole members is individually collapsible to a reduced height, and said reduced height is approximately equal to the transport height dimension of the apparatus.

12. The apparatus according to claim 10, further comprising:

a handle secured to the protective panel member.

13. The apparatus according to claim 10, further comprising:

securement structure disposed near a lower edge of the plurality of flexible barrier panel members for temporarily affixing the flexible barrier panel members to the pole members.

14. The apparatus according to claim 13, wherein the securement structure is a hook and loop fastener assembly positioned between the pole member and an interior surface of the support structure.

15. The apparatus according to claim 10, wherein the support structures are cylindrical in form and sized to receive the pole members.

16. The apparatus according to claim 10, wherein the plurality of flexible barrier panel members are formed from a single sheet of fabric.

17. The apparatus according to claim 10, wherein each of the plurality of flexible barrier panel members may be supported by a pair of pole members interacting with a pair of support structures.

18. The apparatus according to claim 10, wherein the first and second materials have substantially different durability.

19. The apparatus according to claim 10, wherein the protective panel member substantially encircles the plurality of flexible barrier panel members when in the transport configuration;

said plurality of flexible barrier panel members capable of being folded and rolled-up into a generally cylindrical transport configuration, wherein said protective panel member covers the inter-rolled plurality of barrier panel members when in said transport configuration, said transport configured roll of flexible barrier members having a transport height dimension which is substantially shorter than the overall deployed height of said apparatus.

20. A portable environmental barrier apparatus, said apparatus comprising:

a plurality of flexible barrier panel members, each of said barrier panel members being attached to at least one other of said barrier panel members, each of said plurality of flexible barrier panel members further having a pair of associated support structures for supporting the plurality of barrier panel members in an upright deployed orientation, each of said plurality of flexible barrier panel members having a first height dimension in said upright deployed orientation, and at least one of said plurality of flexible barrier panel members being composed of a first material;

a flexible protective panel member being attached to said plurality of flexible barrier panel members, said flexible protective panel member having at least one support structure for supporting the protective panel member in an upright deployed orientation, said flexible protective panel member having a second height dimension in said upright deployed orientation which is substantially shorter than the first height dimension, and said flexible protective panel member being composed of a second material which is different than the first material;

a plurality of ground penetrable pole members for engaging the support structures and supporting said plurality of flexible barrier members and said protective panel member in the upright deployed configuration; and said plurality of flexible barrier panel members capable of being folded and rolled-up into a generally cylindrical transport configuration, wherein said protective panel member covers the inter-rolled plurality of barrier panel members when in said transport configuration.

21. The apparatus according to claim 20, wherein the different materials have substantially different thickness.

* * * * *